US009032678B2

(12) United States Patent
Shaw et al.

(10) Patent No.: US 9,032,678 B2
(45) Date of Patent: May 19, 2015

(54) SYSTEM, METHOD AND APPARATUS FOR UNDER DECK DRAINAGE

(71) Applicant: CertainTeed Corporation, Valley Forge, PA (US)

(72) Inventors: Robert D. Shaw, Parma, MI (US); Thomas C. Gilbert, Clarklake, MI (US); David J. Stucky, Grass Lake, MI (US); Nikki J. Whitney, Lansing, MI (US); Lucas D. Wood, Lansing, MI (US); Stephen W. Steffes, McPherson, KS (US)

(73) Assignee: CERTAINTEED CORPORATION, Valley Forge, PA (US)

( * ) Notice: Subject to any disclaimer, the term of this patent is extended or adjusted under 35 U.S.C. 154(b) by 0 days.

(21) Appl. No.: 14/203,086

(22) Filed: Mar. 10, 2014

(65) Prior Publication Data

US 2014/0260026 A1 Sep. 18, 2014

Related U.S. Application Data

(60) Provisional application No. 61/794,375, filed on Mar. 15, 2013.

(51) Int. Cl.

| | |
|---|---|
| ***E04B 1/70*** | (2006.01) |
| ***E04B 1/64*** | (2006.01) |
| *E04F 17/00* | (2006.01) |

(52) U.S. Cl.

CPC ..... *E04B 1/64* (2013.01)

(58) Field of Classification Search

CPC ..... E04B 1/64; E04B 5/48; E04C 2/52

USPC ..... 52/39, 302.1, 302.3, 302.6, 506.06, 52/506.08, 506.09, 506.1, 712; 248/231.81, 301, 302, 303, 304, 316.7, 248/690, 692

See application file for complete search history.

(56) References Cited

U.S. PATENT DOCUMENTS

| | | | | | |
|---|---|---|---|---|---|
| 1,818,268 | A | * | 8/1931 | Noblitt | 165/99 |
| 1,878,812 | A | * | 9/1932 | Berger | 138/107 |
| 2,479,137 | A | * | 8/1949 | Schudy | 211/119.15 |
| 2,587,150 | A | * | 2/1952 | Hansen et al. | 248/58 |
| 4,065,883 | A | * | 1/1978 | Thibodeau | 52/11 |
| 4,432,518 | A | * | 2/1984 | Navarre | 248/48.2 |
| 4,446,660 | A | * | 5/1984 | Miller et al. | 248/250 |
| 4,663,894 | A | * | 5/1987 | LaRoche et al. | 52/15 |
| 4,860,502 | A | * | 8/1989 | Mickelsen et al. | 52/11 |
| 5,081,812 | A | * | 1/1992 | Reynolds | 52/506.06 |
| 5,195,281 | A | * | 3/1993 | Kosko | 52/11 |
| 5,345,727 | A | | 9/1994 | McCrea | |
| 5,511,351 | A | | 4/1996 | Moore | |
| 5,697,587 | A | * | 12/1997 | Israel | 248/214 |
| 5,725,293 | A | * | 3/1998 | Wilkening et al. | 312/248 |

(Continued)

*Primary Examiner* — Charles A Fox
*Assistant Examiner* — Joseph J Sadlon
(74) *Attorney, Agent, or Firm* — Alexander H. Plache; Abel Law Group, LLP

(57) ABSTRACT

A deck drainage system includes a plurality of hanger clips. Each hanger clip may have a plurality of mounting holes configured to fasten the hanger clip to a support at selected elevations. A soffit may be mounted to the hanger clips without fasteners and located completely below the deck, such that not every hanger clip directly contacts the soffit. A slope of the soffit may be selected by mounting at least two of the hanger clips to the support at different vertical elevations. The soffit may be configured to slope beneath the deck and drain water therefrom in a selected direction.

20 Claims, 9 Drawing Sheets

(56) References Cited

U.S. PATENT DOCUMENTS

| | | | | |
|---|---|---|---|---|
| 5,765,328 | A | 6/1998 | Moore | |
| 6,164,019 | A * | 12/2000 | Salley | 52/11 |
| 6,226,941 | B1 | 5/2001 | Stevens | |
| 6,279,271 | B1 | 8/2001 | Burkart, Jr. | |
| 6,393,785 | B1 | 5/2002 | Burt | |
| 6,415,571 | B2 | 7/2002 | Risser | |
| 6,421,967 | B1 * | 7/2002 | Wlaker | 52/198 |
| 6,435,105 | B1 * | 8/2002 | Mikich et al. | 108/42 |
| 6,446,876 | B1 * | 9/2002 | Stefano et al. | 236/49.3 |
| 6,796,092 | B1 * | 9/2004 | Goebel | 52/302.1 |
| 7,051,485 | B2 * | 5/2006 | Burnette | 52/578 |
| 7,434,358 | B2 | 10/2008 | Smith | |
| 7,584,580 | B1 | 9/2009 | Adair, Jr. et al. | |
| 7,950,201 | B1 | 5/2011 | Adair, Jr. et al. | |
| 8,082,712 | B1 * | 12/2011 | Butler et al. | 52/302.1 |
| 8,245,451 | B2 | 8/2012 | Whitten | |
| 8,661,739 | B2 * | 3/2014 | Keenan | 52/27 |
| 2006/0162262 | A1 | 7/2006 | Smith | |
| 2008/0250734 | A1 * | 10/2008 | Walker | 52/198 |
| 2009/0266018 | A1 * | 10/2009 | Stockton | 52/302.3 |
| 2011/0067350 | A1 | 3/2011 | Adair, Jr. et al. | |
| 2011/0099934 | A1 | 5/2011 | Rhoad, II | |
| 2012/0042580 | A1 | 2/2012 | Manson | |
| 2014/0245681 | A1 * | 9/2014 | Carrubba | 52/302.3 |

* cited by examiner

SYSTEM, METHOD AND APPARATUS FOR UNDER DECK DRAINAGE

This application claims priority to and the benefit of U.S. Prov. App. No. 61/794,375, filed Mar. 15, 2013, and is incorporated herein by reference in its entirety.

BACKGROUND OF THE INVENTION

1. Field of the Disclosure

The present invention relates in general to outdoor decking and, in particular, to a system, method and apparatus for deck water drainage.

2. Description of the Related Art

Numerous attempts have been made to provide drainage systems for decks to prevent water and debris passing through the deck floorboards from reaching the space beneath the deck. Some of these systems are permanently installed below the deck, creating difficulties when it is necessary to clear away debris that has fallen between deck floorboards into the collection system. Other systems do not provide a level of finished appearance desired for more expensive homes. U.S. Pat. No. 6,226,941, describes a deck drainage system in which water collection panels are not permanently attached to the building structure and which can be cleaned. However, the collection panels span an entire dimension of the deck without intermediate support, and as a result their weight is borne by tubular beams underlying the ends of the panels. This requires relatively complex and expensive manufacture of the components for the system. Other deck drainage systems are described in U.S. Pat. Nos. 6,279,271 and 7,434,358. Improvements in deck drainage systems continue to be of interest.

SUMMARY

Embodiments of a system, method and apparatus for deck drainage are disclosed. For example, a deck drainage system may comprise a plurality of hanger clips. Each hanger clip may have a plurality of mounting holes configured to fasten the hanger clip to a support at selected elevations. A soffit may be mounted to the hanger clips without fasteners and located completely below the deck, such that not every hanger clip directly contacts the soffit. A slope of the soffit may be selected by mounting at least two of the hanger clips to the support at different vertical elevations. The soffit may be configured to slope beneath the deck and drain water therefrom in a selected direction.

Other embodiments of a deck drainage system may comprise a plurality of hanger clips configured to be fastened to a support. Each hanger clip may have a hanger clip rim. A plurality of soffits may be mounted to the hanger clips. Each soffit may have a first rim complementary in shape to the hanger clip rim and configured to mount directly to the hanger clip rim. Each soffit may have a second rim complementary in shape to the first rim and configured to mount directly to the first rim of an adjacent soffit.

Still another embodiment of a deck drainage system may comprise a plurality of hanger clips configured to be fastened to a support. Each hanger clip may have an interior clip and an exterior clip. A soffit may be mounted to the interior clip of a first one of the hanger clips at an interior of the deck. The soffit also may be mounted to the exterior clip of a second one of the hanger clips adjacent an exterior of the deck.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
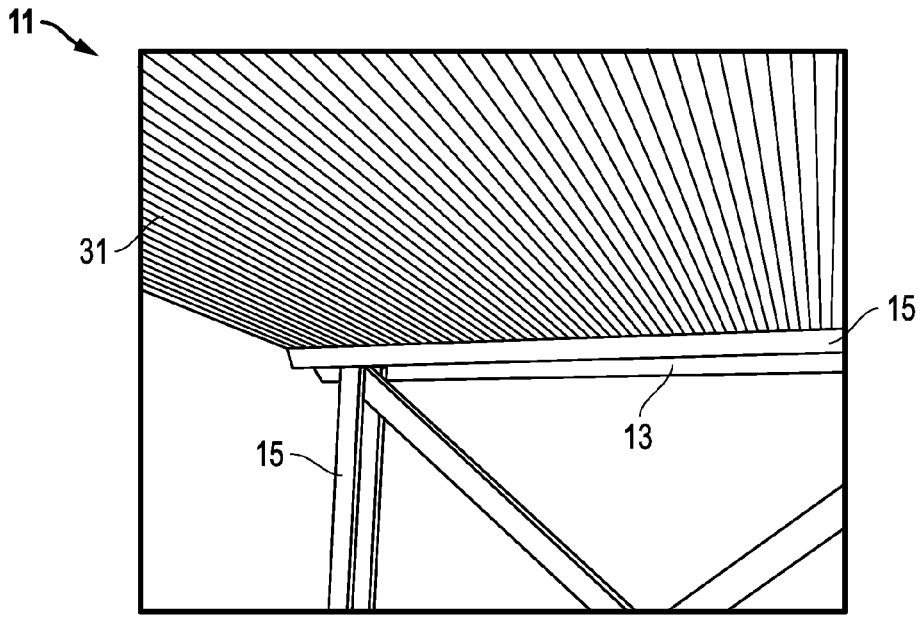
FIG. 1 is an isometric bottom view of an embodiment of a deck drainage system.
Figure 2:
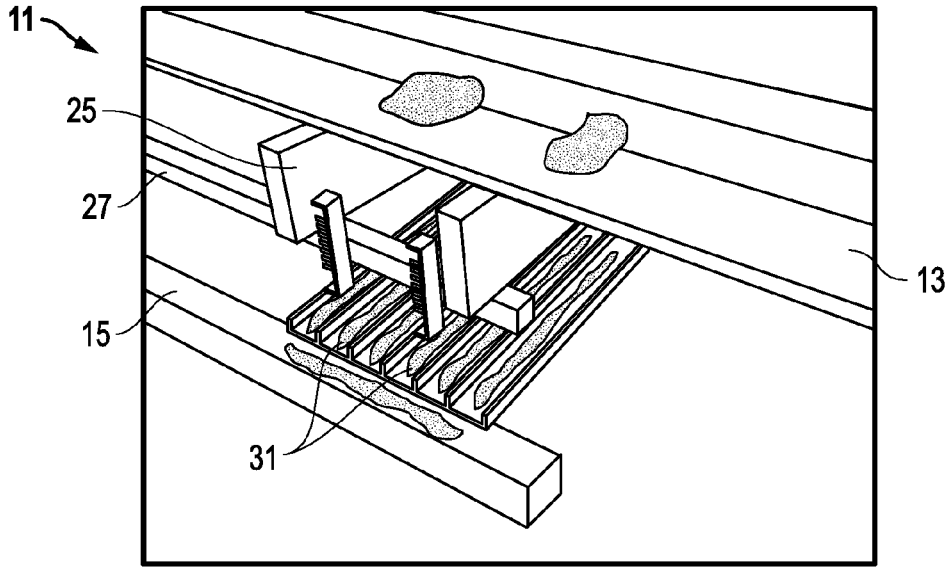
FIG. 2 is a schematic isometric top view of a portion of an embodiment of a deck drainage system draining water from a deck.

Embodiments of a system, method and apparatus for deck drainage are disclosed. For example, as shown in FIGS. 1 and 2, a deck drainage system 11 may be secured to an outdoor deck 13 to help maintain a dry space below the deck 13. The deck drainage system 11 includes components that capture water that drains through the deck 13 to an under side of the deck 13. In some versions, the deck drainage system 11 may be used in conjunction with a gutter system 15 to guide the drained water to a desired location.

In some embodiments (FIGS. 2-4), the deck drainage system 11 may comprise a plurality of hanger clips 21. Each hanger clip 21 may be provided with having a plurality of mounting holes 23 configured to fasten the hanger clip 21 to a support at selected elevations. The mounting holes 23 may comprise horizontally adjacent pairs of mounting holes 23, as illustrated. In some versions, the adjacent pairs of mounting holes 23 are vertically spaced apart from other ones of the adjacent pairs of mounting holes 23, such as by about 0.5 inch.

Embodiments of the supports to which the hanger clips 21 are mounted may comprise grid bars 27. Grid bars 27 may be attached to deck joists 25, such as with fasteners like screws or nails. Alternatively, the supports may comprise the deck joists 25 themselves, such that the hanger clips 21 are secured or fastened directly to the deck joists 25 without the need or use of grid bars 27. The hanger clips 21 may be fastened only to substantially vertical surfaces of the support, whether the deck joists 25 or the grid bars 27.

As shown in FIGS. 1, 2, 5 and 6, embodiments of the deck drainage system 11 may include soffit 31 mounted to the hanger clips 21. The soffit 31 may be secured to the hanger clips 21 without fasteners, and may be located completely below the deck 13, which may include the deck joists 25 as well. However, in some embodiments, not every hanger clip 21 used to support soffit 31 directly contacts the soffit 31, as will be explained elsewhere herein.

In addition, the soffit 31 may be sloped at a selected angle of inclination to enable water drainage in a selected direction. In some versions, the slope of the soffit 31 may be selected by mounting at least two of the hanger clips 21 to the support at different vertical elevations, such that the soffit is configured to slope beneath the deck and drain water therefrom in a selected direction. Embodiments of the soffit 31 may be located completely below the deck joists 25 of the deck 13, not vertically between the deck joists 25 as is the case with some conventional designs.

Again referring to FIGS. 3 and 4, embodiments of the hanger clips 21 may comprise a body 41 and a mounting portion 43 extending from the body 41. The mounting holes 23 may be formed in the mounting portion 43, in some versions. The mounting portion 43 may be configured to be substantially perpendicular to the body 41. The hanger clips 21 may further comprise reinforcements 45 extending between the body 41 and the mounting portion 43.

Figure 8:
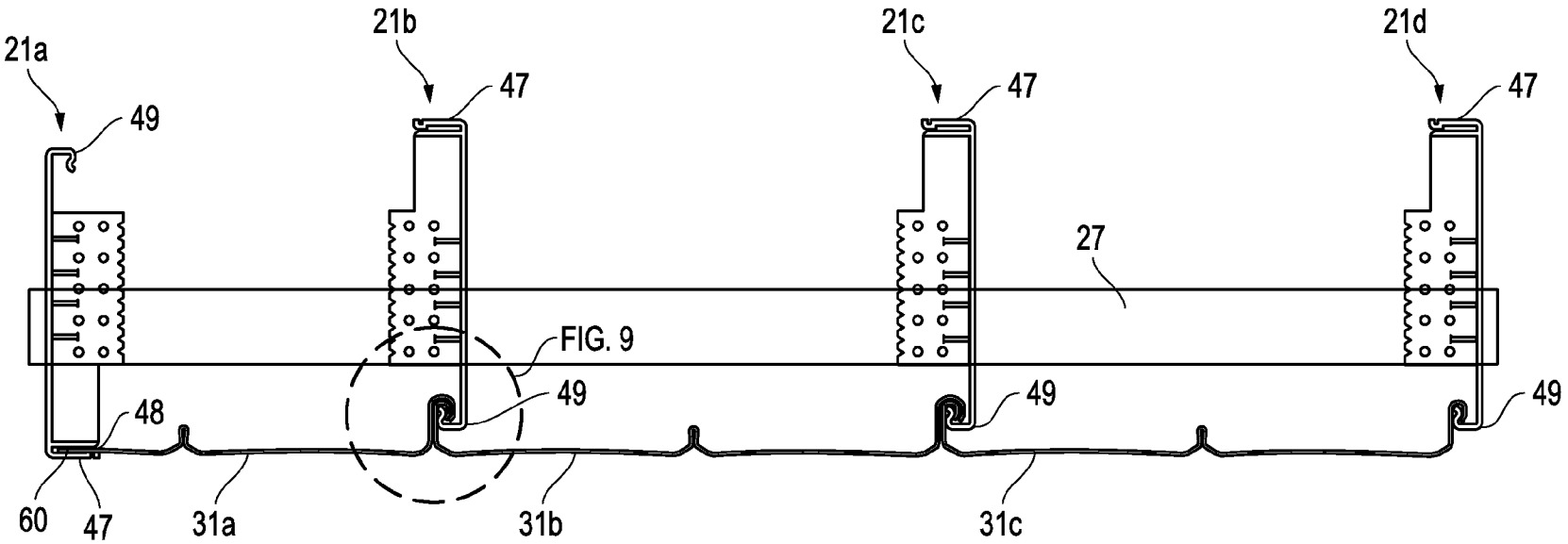
FIG. 8 is a sectional end view of an embodiment of a deck drainage system.

Embodiments of the hanger clip 21 may be provided with first and second clips 47, 49, both of which may extend from the body 41. The first clip 47 may be used in a first orientation, and the second clip 49 may be used in a second orientation that is different than the first orientation. The first and second orientations may comprise opposite vertical orientations. For example, the first orientation may be suitable along a perimeter of the drainage system 11 (e.g., hanger clip 21*a* in FIG. 8), whereas the second orientation may be suitable in an interior of the drainage system 11 (e.g., hanger clips 21*b*, 21*c* and 21*d* in FIG. 8). In some embodiments, the first orientation may be used for the lateral perimeter of the drainage system 11, and the second orientation may be used therebetween.

Figure 3:
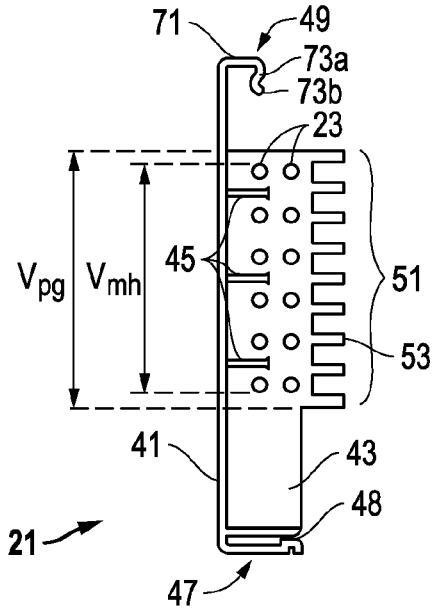
FIGS. 3 and 4 are front and side views of an embodiment of a hanger clip for the deck drainage system.
Figure 4:
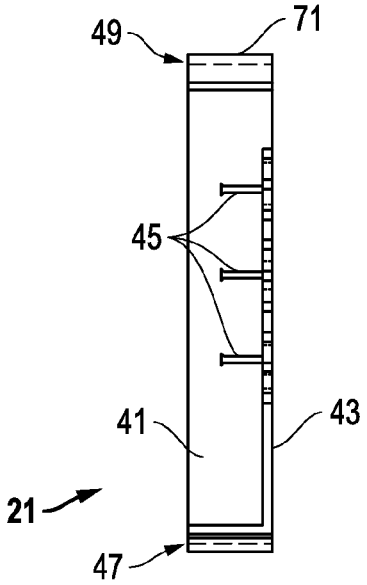

In some embodiments, each hanger clip 21 may further comprise a pitch gauge 51 that may be configured to assist an installer (e.g., as a visual aid) to adjust the slope of the drainage system 11. As shown in FIG. 3, the vertical span of the pitch gauge 51 (Vpg) may exceed a vertical span of the mounting holes 23 (Vmh). Versions of the pitch gauge 51 may comprise fingers, notches or tabs 53 extending from each hanger clip 21. At least some of the adjacent fingers, notches or tabs 53 may vertically straddle adjacent ones of the mounting holes 23, as shown in FIG. 3.

Figure 7:
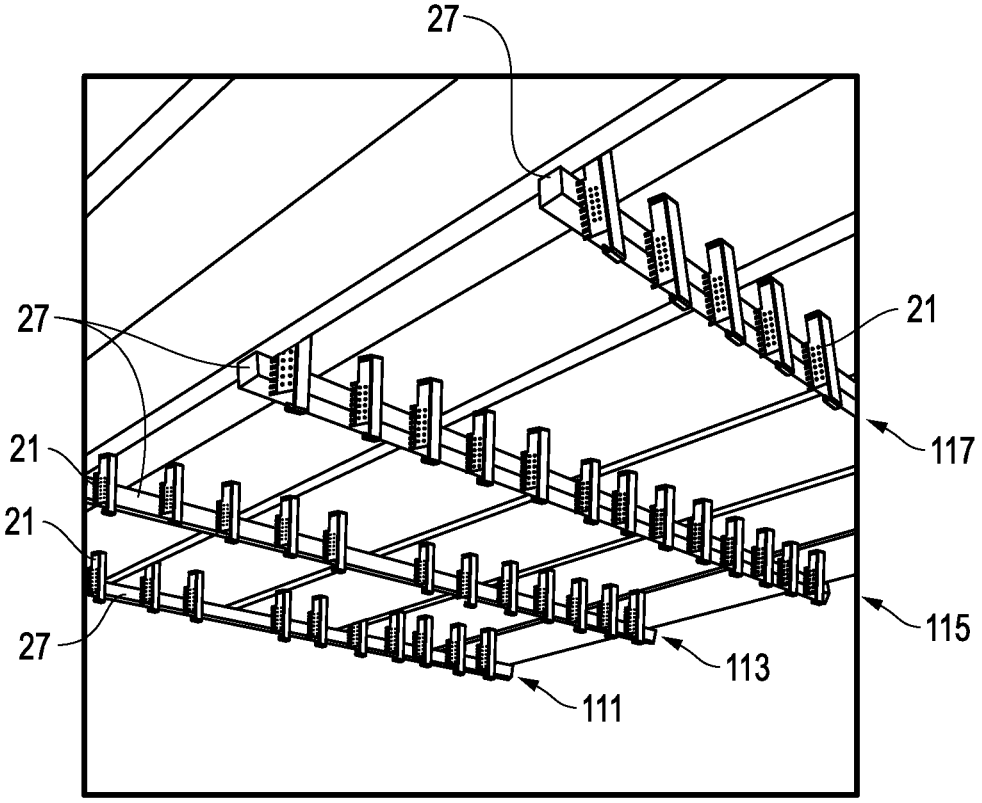
FIG. 7 is a schematic isometric bottom view of a portion of an embodiment of a deck drainage system, shown partially installed.
Figure 14:
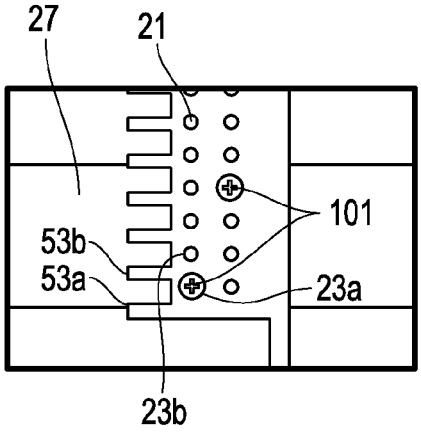
FIGS. 14 and 15 are partial front views of an embodiment of an installation of a deck drainage system shown at two different vertical elevations.
Figure 15:
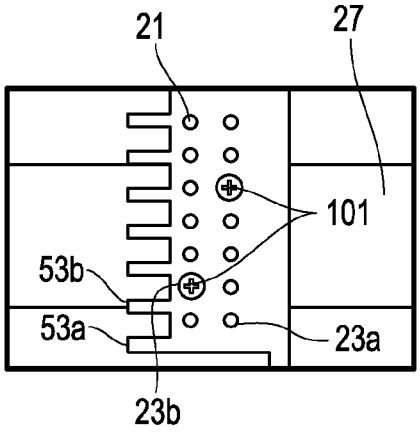
Figure 16:
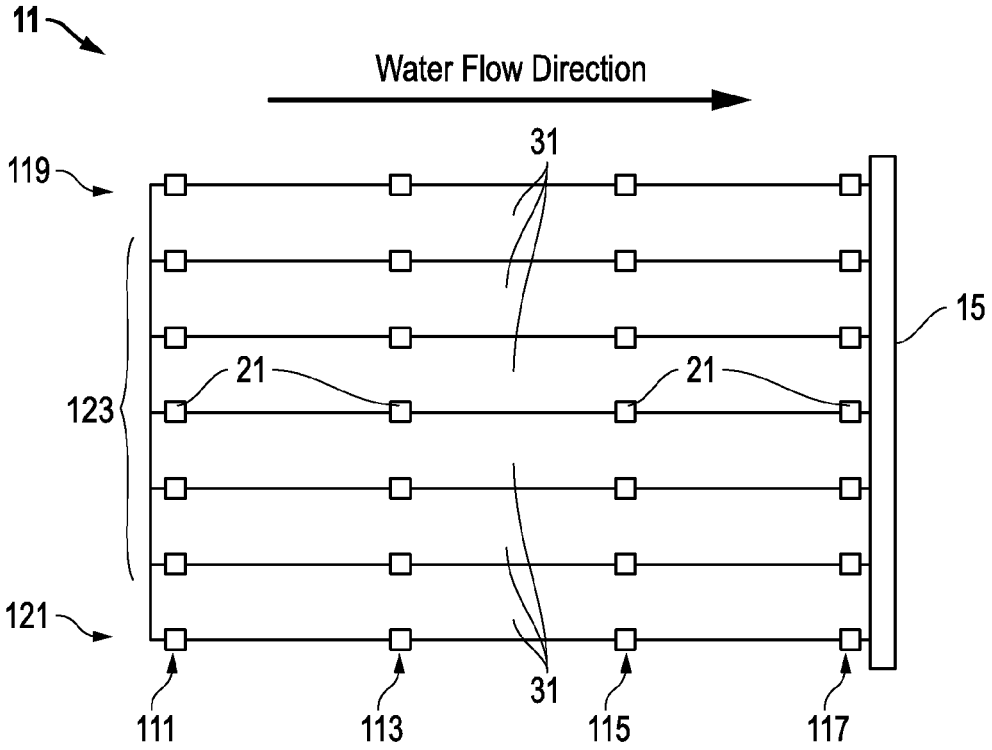
FIG. 16 is a schematic diagram of an embodiment of a deck drainage system.

As depicted in FIGS. 3, 14 and 15, the pitch gauge 51 is configured to be used to selectively position the hanger clip 21 relative to a lower surface of the support (e.g., grid bars 27) to form the slope of the soffit 31 (FIGS. 1 and 16). In FIG. 7, the downward slope of the drainage system is substantially from the lower left of that image to the upper right of that image. Thus, the hanger clips 21 on the lower left (first course 111) are mounted to their support (i.e., grid bar 27) at a highest vertical elevation (e.g., most tabs 53 above grid bar 27) of the drainage system 11. In contrast, the hanger clips 21 on the upper right (course 117) are mounted to their support (i.e., grid bar 27) at a lowest vertical elevation (e.g., no tabs 53 above grid bar 27) of the drainage system 11. The hanger clips 21 located between the highest and lowest vertical elevations (those in the other courses 113, 115) may be carefully graded to gradually reduce the vertical elevation therebetween.

Embodiments of the drainage system 11 may require no shims to form the slope of the soffit 31. However, depending on the levelness of the deck joists 25, some shims may be required between the grid bars 27 and the deck joists 25 to support the grid bars 27 in a level array.

Figure 9:
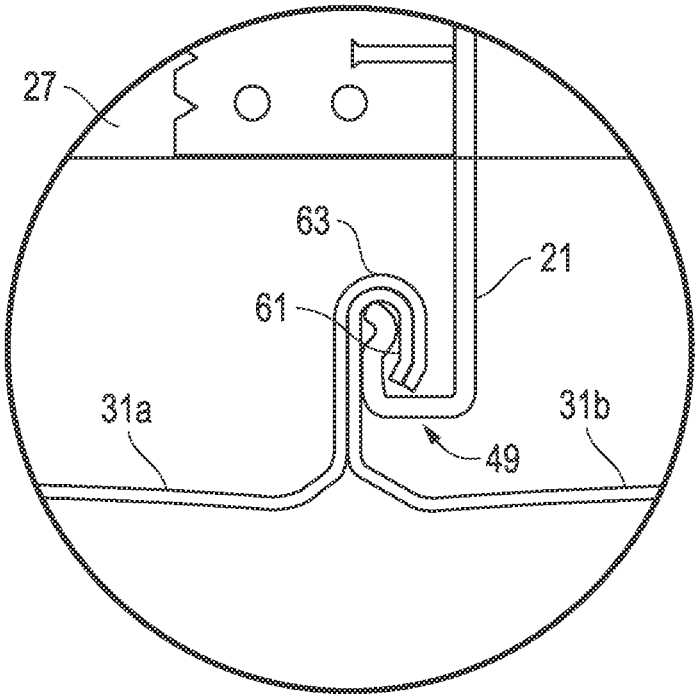
FIG. 9 is an enlarged sectional end view of a portion of the deck drainage system of FIG. 8.
Figure 10:
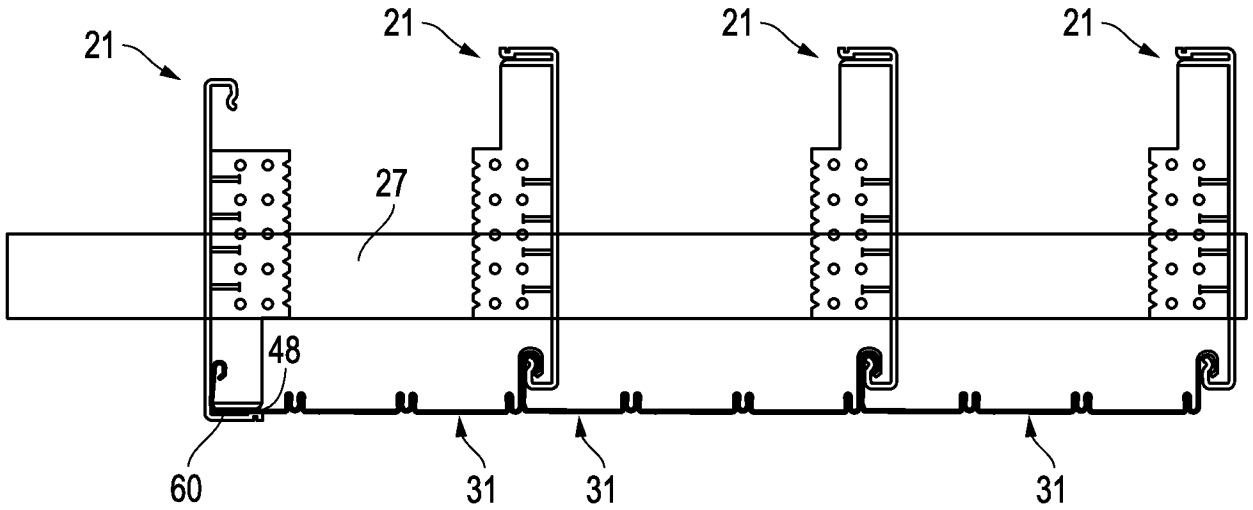
FIG. 10 is a sectional end view of another embodiment of a deck drainage system.
Figure 11:
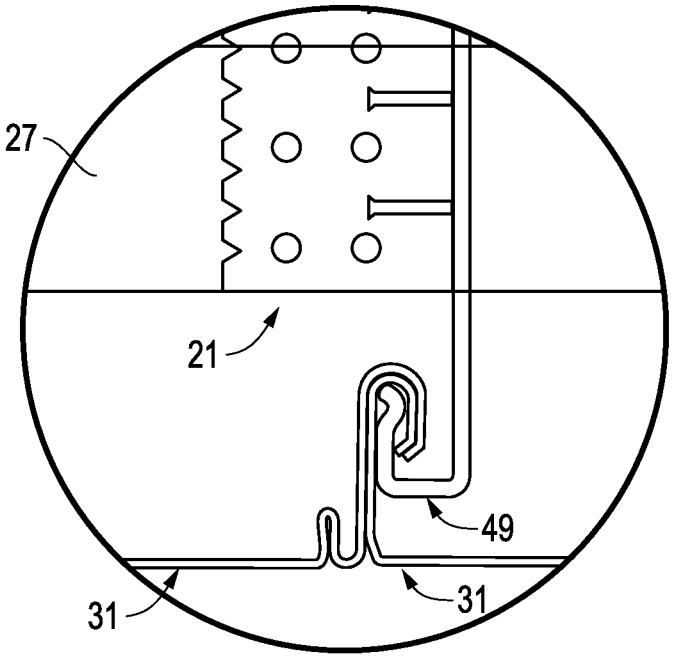
FIG. 11 is an enlarged sectional end view of a portion of the deck drainage system of FIG. 10.

In some versions (see FIGS. 8-11), the hanger clips 21 located along one longitudinal side of the soffit 31 (i.e., the left side of each soffit) directly contact the soffit 31. However, the hanger clips 21 along the other longitudinal side of the soffit 31 (i.e., the right side of each soffit) do not directly contact the soffit 31 but only directly contact adjacent soffit 31. For example, FIG. 9 depicts the right side of soffit 31*a* and the left side of soffit 31*b*. Hanger clip 21 only directly contacts (i.e., physically touches) the left side of soffit 31*b*. Hanger clip 21 does not directly contact (i.e., does not physically touch) the right side of soffit 31*a*. Thus, hanger clip 21 directly supports soffit 31*b* but only indirectly supports soffit 31*a*. This configuration may characterize the deck drainage system 11 as having nested rims with at least two soffits 31.

Other embodiments of an under deck drainage system 11 may comprise a plurality of hanger clips 21 configured to be fastened to a support (e.g., deck joist 25 or grid bar 27). Each hanger clip 21 may be provided with a hanger clip rim (also referred to herein as the second clip 49). A plurality of soffits 31 may be mounted to the hanger clips 21.

Referring again to FIGS. 5, 6 and 9, each soffit 31 may be provided with a first rim 61 that is complementary in shape to the hanger clip rim 49. First rims 61 may be configured to mount directly to the hanger clip rim 49. In addition, each soffit 31 may comprise a second rim 63 that is complementary in shape to the first rim 61 and configured to mount directly to the first rim 61 of an adjacent soffit. Thus, the hanger clip rims 49 on the hanger clips 21 along one longitudinal side of the soffit 31 directly contact the first rims 61 of the soffit 31*b* (FIG. 9), and the hanger clip rims 49 on the hanger clips 21 along the other longitudinal side of the soffit 31*a* do not directly contact the soffit 31. In effect, the hanger clip rim 49 nests inside the first rim 61, and the first rim 61 nests inside the second rim 63 of the adjacent soffit 31.

Embodiments of the first and second rims 61, 63 may extend in a same lateral direction (i.e., into and out of the page in FIGS. 8-11). Respective sets of the hanger clip rims 49, first rims 61 and second rims 63, may positively engage each other to form a retention force therebetween. In some versions, the retention force must be overcome to disengage respective sets of the hanger clip rims 21, first rims 61 and second rims 63.

In some examples (e.g., FIGS. 5 and 6), each of the first and second rims 61, 63 may comprise a hook 65 and a tab 67 extending inward therefrom. The hooks 65 and tabs 67 of the first and second rims 61, 63 may be respectively complementary.

Embodiments of the exterior clips 47 may be utilized with soffit 31 by first cutting or removing one of the first or second rims 61, 63 to form a cut end 60. See, e.g., FIGS. 8, 10 and 13. Cut ends 60 essentially comprise only the flat planar body 32 of a soffit 31. Cut ends 60 are received in a slit 48 of exterior clips 47, as shown. Slits 48 snugly grip cut ends 60 such that they are retained by a pinch force.

Embodiments of the hanger clip rim 49 may comprise a flat portion 71 (FIG. 3) extending from the hanger clip 21, and a hook 73 extending from the flat portion 71. The hook 73 may comprise a convex portion 73*a* that curves from the flat portion 71 toward the hanger clip 21, and a concave portion 73*b* that curves from the convex portion 73*a* away from the hanger clip 21.

Figure 5:
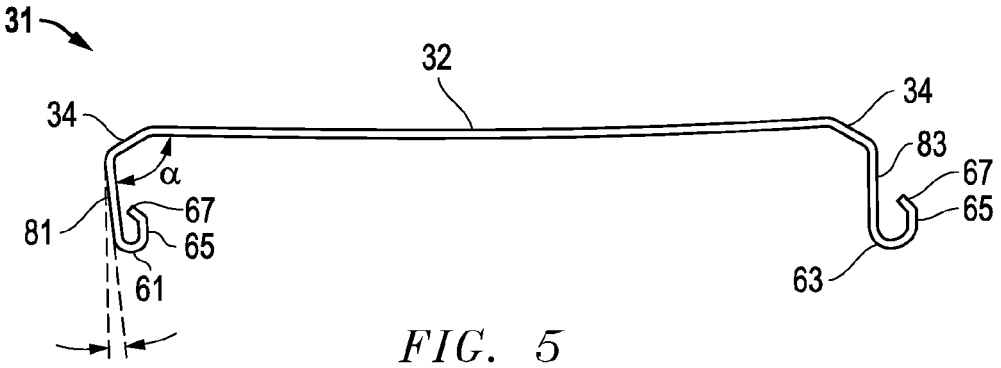
FIGS. 5 and 6 are sectional end views of embodiments of soffit for the deck drainage system.
Figure 6:
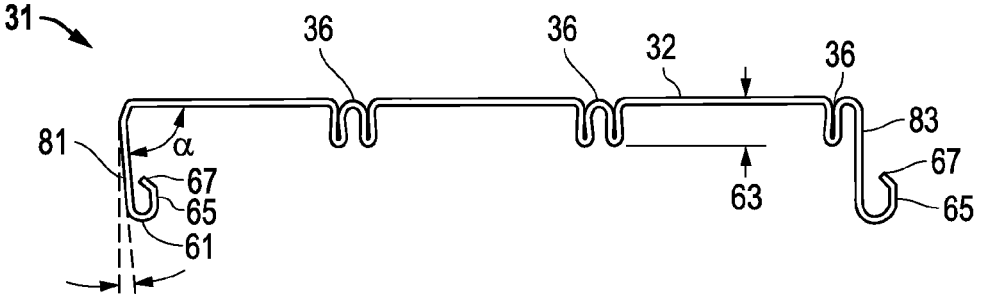

Embodiments of the soffit 31 may be provided with first and second side walls 81, 83 (FIGS. 5 and 6). The first and second rims 61, 63 may extend from the first and second side walls 81, 83, respectively. In one example, the first side wall 81 may be formed at an acute angle α relative to a body 32 of the soffit 31. The acute angle α may comprise, for example, about 85 degrees+/− about 2 degrees. This acute angle α or taper tends to pre-load the soffits 31 against each other upon installation. Thus, in some embodiments, shapes of the first and second side walls 81, 83 of adjacent connected soffits 31 may be configured to pre-load the adjacent connected soffits 31 against each other. The second side wall 83 may be formed substantially perpendicular to the body 32 of the soffit 31. Body 32 also may comprise decorative or ornamental features, such as edge chamfers 34 (FIG. 5) or beads 36 (FIG. 6), for example.

Still other embodiments of the deck drainage system 11 may comprise a plurality of hanger clips 21 configured to be fastened to a support (e.g., deck joist 25 or grid bar 27). Each hanger clip 21 may be characterized as having an exterior clip 47 (also referred to herein as a first clip), and an interior clip 49 (also referred to herein as a second clip). A soffit 31 may be mounted to the interior clip 49 of a first one of the hanger clips 21 at an interior of the deck 13. In addition, the same or other soffit 31 may be mounted to the exterior clip 47 of a second one of the hanger clips 21 adjacent an exterior of the deck 13. The interior clip 49 may be located on one end of the hanger clip 21. The exterior clip 47 may be located opposite the interior clip 49. A slope of the soffit 31 may be selected by mounting at least two of the hanger clips 21 to the support at different vertical elevations, such that the soffit 31 is sloped to drain water.

Embodiments of the hanger clips 21 may be provided with a vertical series of mounting holes 23. In some versions, at least two of the hanger clips 21 may be mounted to the support via their mounting holes 23 but at different vertical elevations to form the slope of the soffit 31.

Figure 12:
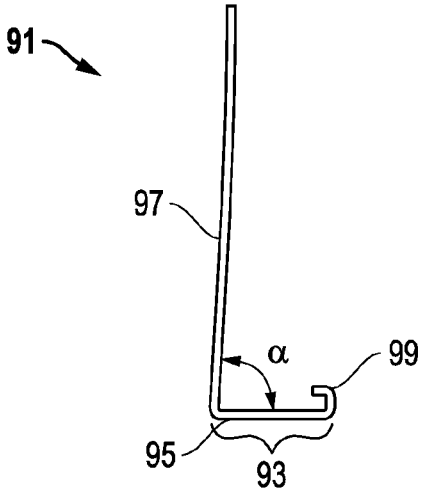
FIGS. 12 and 13 are end views of an embodiment of a fascia shown alone and installed on a deck drainage system, respectively.
Figure 13:
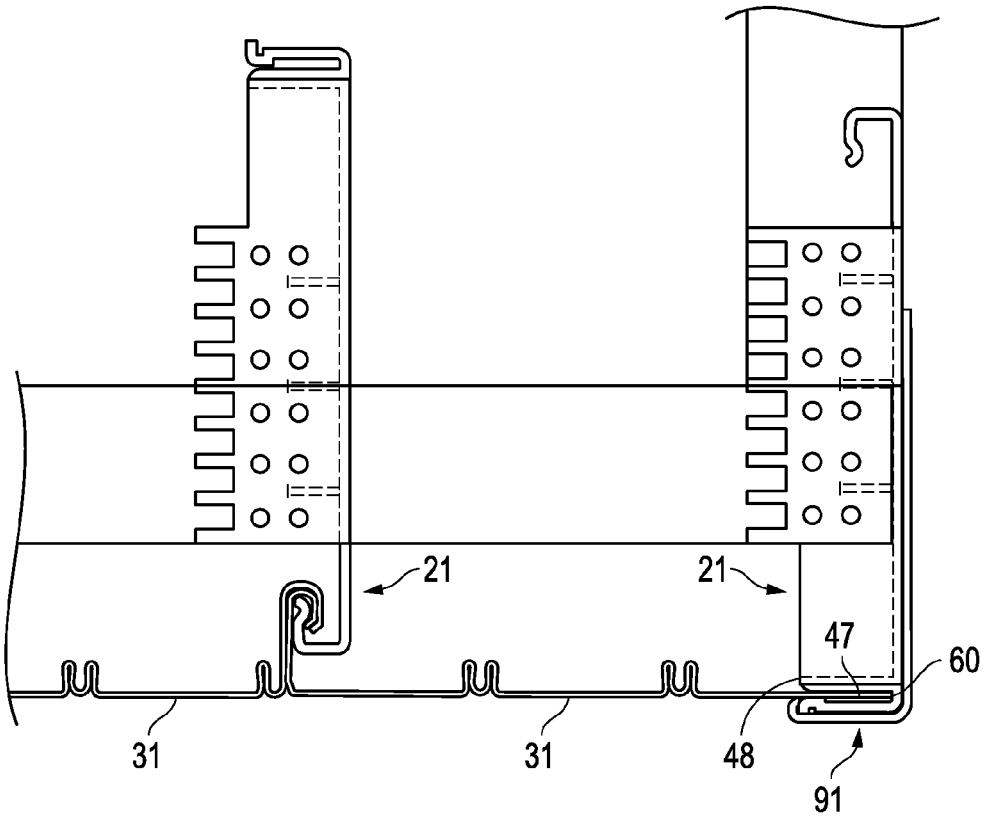

Some embodiments of the deck drainage system 11 may further comprise a fascia 91 (FIGS. 12 and 13). The fascia 91 may be configured to be mounted to at least some of the hanger clips 21, such as those around a perimeter or exterior of the deck drainage system 11. The fascia 91 may be provided with an attachment portion 93 that is complementary in shape and secured to the exterior clips 47 of second ones of the hanger clips 21. The attachment portion 93 may comprise a butt end 95 extending from a body 97 of the fascia 91, and a fascia hook 99 extending inwardly from the butt end 95. The butt end 95 may be oriented at an acute angle α with respect to the body 97 of the fascia 91. For example, the acute angle α may comprise about 85 degrees+/− about 2 degrees. This acute angle α or taper tends to pre-load the fascia 91 against the hanger clips 21 upon installation. Thus, in some embodiments, shapes of the first and second side walls 81, 83 of adjacent connected soffits 31 may be configured to pre-load the adjacent connected soffits 31 against each other.

In some embodiments of the deck drainage system 11, the only fasteners required to mount the drainage system 11 to the support are fasteners 101 (e.g., see screws or nails in FIGS. 7, 14 and 15) that secure the hanger clips 21 to the support. No other fasteners may be required. Thus, the hanger clips 21 and soffit 31 are fastenerless such that the interior and exterior clips 47, 49 require no fasteners to secure the soffit 31 thereto.

For example, at higher vertical elevations (FIGS. 7, 14 and 16), such as the first course 111 of hanger clips 21, the lowermost tab 53*a* of pitch gauge 51 may be aligned with the bottom of the support 27. This allows a fastener 101 to insert through the lowermost mounting hole 23*a* (and those above it) to secure hanger clip 21 to support 27. At lower vertical elevations (FIG. 15), such as the next course 113 of hanger clips 21, the second lowest tab 53b of pitch gauge 51 may be aligned with the bottom of the support 27. This allows a fastener 101 to insert through the second lowest mounting hole 23*b* (and those above it) to secure hanger clip 21 to support 27. This process may progress to the next sets of tabs 53 and mounting holes 23 in courses 115 and 117 (FIG. 16). Such a configuration gradually lowers the vertical elevations of the soffit 31 from left to right (i.e., the water flow direction), such that any water collected by deck drainage system 11 may be deposited in gutter system 15 along the right edge thereof.

In addition, note that the hanger clips 21 along the perimeter courses 119 and 121 would be secured to soffit 31 with exterior clips 47, while hanger clips 21 that extend along the interior courses 123 would be secured to soffit 31 with interior clips 49. The exterior clips 47 may be used for soffit connections along a lateral perimeter of the deck drainage system 11. The interior clips 49 may be used for soffit connections in an interior of the deck drainage system 11 other than the lateral perimeter, as shown.

Embodiments of a method of installing a deck drainage system also may be provided. In one version, the method may comprise providing a plurality of hanger clips, each having a plurality of mounting holes; fastening the hanger clips through their mounting holes to a support at different vertical elevations relative to the support to define a slope for a soffit; and then mounting the soffit to the hanger clips without fasteners, such that the soffit is located completely below the deck and is sloped to drain water therefrom in a selected direction.

Another embodiment of a method of installing a deck drainage system may comprise fastening a plurality of hanger clips to a support, each hanger clip having a hanger clip rim; providing a plurality of soffits, each having a first rim complementary in shape to the hanger clip rim, and a second rim complementary in shape to the first rim; and then mounting the soffits to the hanger clips by mounting the first rims directly to the hanger clip rims and mounting the second rims directly to the first rims of adjacent soffits.

Still another embodiment of a method of installing a deck drainage system may comprise fastening a plurality of hanger clips to a support, each hanger clip having an interior clip and an exterior clip; and then mounting a soffit to the interior clip of a first one of the hanger clips at an interior of the deck, and to the exterior clip of a second one of the hanger clips adjacent an exterior of the deck.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A deck drainage system, comprising:

a plurality of hanger clips, each having a plurality of mounting holes configured to fasten the hanger clip to a support at selected vertical elevations, and the support comprises a deck joist or a grid bar attached to deck joists;

a soffit configured to be mounted to the hanger clips without fasteners and located completely below a deck, such that the soffit is located completely below the deck joists, not vertically between the deck joists; and a slope of the soffit is configured to be selected by mounting at least two of the hanger clips to the support at different vertical elevations relative to the support, such that the soffit is configured to slope beneath the deck and drain water therefrom in a selected direction.

2. A system according to claim 1, wherein each of the hanger clips comprises a body, a mounting portion extending from the body, and the mounting holes are formed in the mounting portion.

3. A system according to claim 2, wherein the hanger clip has first and second clips, both of which extend from the body.

4. A system according to claim 1, wherein each hanger clip further comprises a pitch gauge configured to assist an installer to adjust the slope of the drainage system.

5. A system according to claim 1, wherein the mounting holes comprise horizontally adjacent pairs of mounting holes.

6. A system according to claim 1, wherein the hanger clips are fastened only to substantially vertical surfaces of the support.

7. A system according to claim 1, wherein no shims are required to form the slope of the soffit, and not every hanger clip directly contacts the soffit.

8. A system according to claim 1, wherein hanger clips along one longitudinal side of the soffit directly contact the soffit, and hanger clips along the other longitudinal side of the soffit do not directly contact the soffit but only directly contact an adjacent soffit.

9. A deck drainage system, comprising:

a plurality of hanger clips configured to be fastened to a support, each hanger clip having a hanger clip rim; and a plurality of soffits configured to be mounted to the hanger clips, each soffit having a first rim complementary in shape to the hanger clip rim and configured to mount directly to the hanger clip rim, and a second rim complementary in shape to the first rim and configured to mount directly to the first rim of an adjacent soffit.

10. A system according to claim 9, wherein the hanger clip rims on the hanger clips along one longitudinal side of the soffit directly contact the first rims of the soffit, and hanger clip rims on the hanger clips along the other longitudinal side of the soffit do not directly contact the soffit.

11. A system according to claim 9, wherein the hanger clip rim nests inside the first rim, and the first rim nests inside the second rim of the adjacent soffit.

12. A system according to claim 9, wherein the first and second rims extend in a same lateral direction, and respective sets of the hanger clip rims, first rims and second rims, positively engage each other to form a retention force therebetween, and the retention force must be overcome to disengage respective sets of the hanger clip rims, first rims and second rims.

13. A system according to claim 9, wherein each of the first and second rims comprises a hook and a tab extending inward therefrom, the hooks and tabs of the first and second rims are respectively complementary.

14. A system according to claim 9, wherein each hanger clip further comprises a pitch gauge configured to assist an installer to adjust the slope of the deck drainage system.

15. A system according to claim 9, wherein the hanger clips are fastened only to substantially vertical surfaces of the support, and the soffits are located completely below joists of the deck, not vertically between joists of the deck.

16. A system according to claim 9, wherein no shims are required to form the slope of the soffits.

17. A deck drainage system, comprising:

a plurality of hanger clips configured to be fastened to a grid bar, each hanger clip having an interior clip and an exterior clip; and a soffit configured to be mounted to the interior clip of a first one of the hanger clips at an interior of the deck, and to the exterior clip of a second one of the hanger clips adjacent an exterior of a deck.

18. A system according to claim 17, wherein the interior clip is located on one end of the hanger clip, and the exterior clip is located opposite the interior clip.

19. A system according to claim 17, wherein a slope of the soffit is selected by mounting at least two of the hanger clips to the grid bar at different vertical elevations, such that the soffit is sloped to drain water.

20. A system according to claim 17, further comprising a fascia configured to be mounted to at least some of the hanger clips.

* * * * *